US007841876B2

(12) United States Patent
Lin et al.

(10) Patent No.: US 7,841,876 B2
(45) Date of Patent: Nov. 30, 2010

(54) LOW PROFILE MODULAR JACK HAVING SPRING-BIASED COVER

(75) Inventors: Kuo-Lung Lin, Tu-Cheng (TW); Wei-Chung Lin, Tu-Cheng (TW); Kuo-Chun Hsu, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/646,840

(22) Filed: Dec. 23, 2009

(65) Prior Publication Data

US 2010/0227486 A1 Sep. 9, 2010

(51) Int. Cl.
*H01R 13/44* (2006.01)

(52) U.S. Cl. ..... 439/144; 439/676; 439/946

(58) Field of Classification Search ..... 439/344, 439/676, 131, 142, 144, 946
See application file for complete search history.

(56) References Cited

U.S. PATENT DOCUMENTS 5,336,099 A * 8/1994 Aldous et al. ..... 439/131
5,385,479 A * 1/1995 Okada ..... 439/144
5,562,472 A * 10/1996 Dubois et al. ..... 439/329
5,679,013 A 10/1997 Matsunaga et al.
6,561,824 B1 * 5/2003 Beckham et al. ..... 439/131

* cited by examiner

*Primary Examiner*—Khiem Nguyen
(74) *Attorney, Agent, or Firm*—Andrew C. Cheng; Wei Te Chung; Ming Chieh Chang

(57) ABSTRACT

Provided is an electrical connector including an insulative base defining a mounting face thereof. A plurality of terminals are secured in said insulative base and each has a contacting section projecting upwards thereof. A detachable cover is pivotally assembled on the insulative base and rotates to an opened position where a mating cavity is defined for receiving a mating plug therein and a closed position where the mating cavity is not large enough for receiving said mating plug. At least one resilient tang is located under said cover for providing a supporting force no matter the cover is in the opened position or in the closed position.

5 Claims, 9 Drawing Sheets

LOW PROFILE MODULAR JACK HAVING SPRING-BIASED COVER

BACKGROUND OF THE INVENTION

1. Field of the Invention

The present invention relates a RJ receptacle, and more particular to a collapsible RJ receptacle on which a spring-biased cover is attached and readily receive a RJ plug inserted therein.

2. Description n of the Related Art

U.S. Pat. No. 5,679,013 issued to Matsunaga et al. on Oct. 21, 1997 discloses an open/close type connector having a base member, a cover member, and an electronic apparatus of a card type or a personal computer type using the connector. The connector features a compact and low-profile configuration and readily disposed on a card, so that when it is not used, i.e., is not interconnected with a modular plug, a cover is closed in a way it is flushed with the top of the cover, and the portability of the card is not compromised. In addition, less restriction is introduced on the attachment position at which the connector is attached to the card or the personal computer. An actuator is used to open and close the cover member. Structure for enhancing the stability and the electrical connection reliability when a modular plug is mounted on the connector is provided, and the base member and the cover member are adapted to be pivotal with respect to a pinshaft so that they can be relatively opened or closed thereby creating a connector which can be preferably adopted by an electronic apparatus of a card type.

The modular plug is assembled into the connector in a slantwise manner and forms an angle relative to a horizontal base of the connector when the modular plug is retained therein. However, customers are used a modular plug as it normally does and may inadvertently exert downward pressure upon the modular plug by accident, which will result in fracture of the connector. Obviously, an improved electrical connector is highly desired to overcome the aforementioned problem.

SUMMARY OF THE INVENTION

Accordingly, an object of the present invention is to provide an electrical connector with an improved configuration which can provide a preferred engagement therein.

Another object of the present invention is to provide an electrical connector featured in low-profile configuration while the rigidity will not be compromised.

In order to achieve the object set forth, an electrical connector includes an insulative base defining a mounting face thereof. A plurality of terminals are secured in said insulative base and each has a contacting section projecting upwards thereof. A detachable cover is pivotally assembled on the insulative base and rotates to an opened position where a mating cavity is defined for receiving a mating plug therein and a closed position where the mating cavity is not large enough for receiving said mating plug. At least one resilient tang is located under said cover for providing a supporting force no matter the cover is in the opened position or in the closed position.

Other objects, advantages and novel features of the invention will become more apparent from the following detailed description of the present embodiment when taken in conjunction with the accompanying drawings.

DETAILED DESCRIPTION OF THE INVENTION

Figure 1:
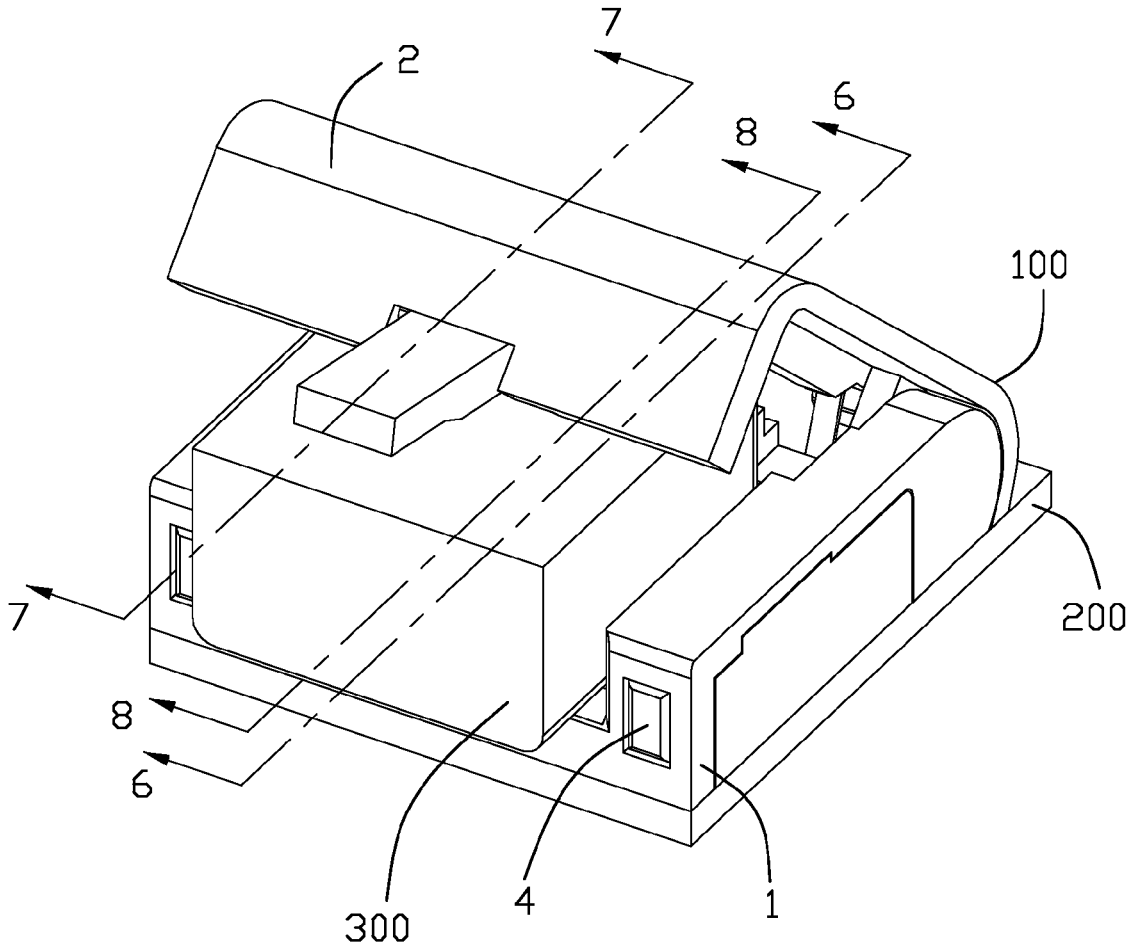
FIG. 1 is a perspective view of an electrical connector made in accordance with the present invention, which shows the electrical connector is mounted onto a printed circuit board with a modular plug inserted therein.
Figure 2:
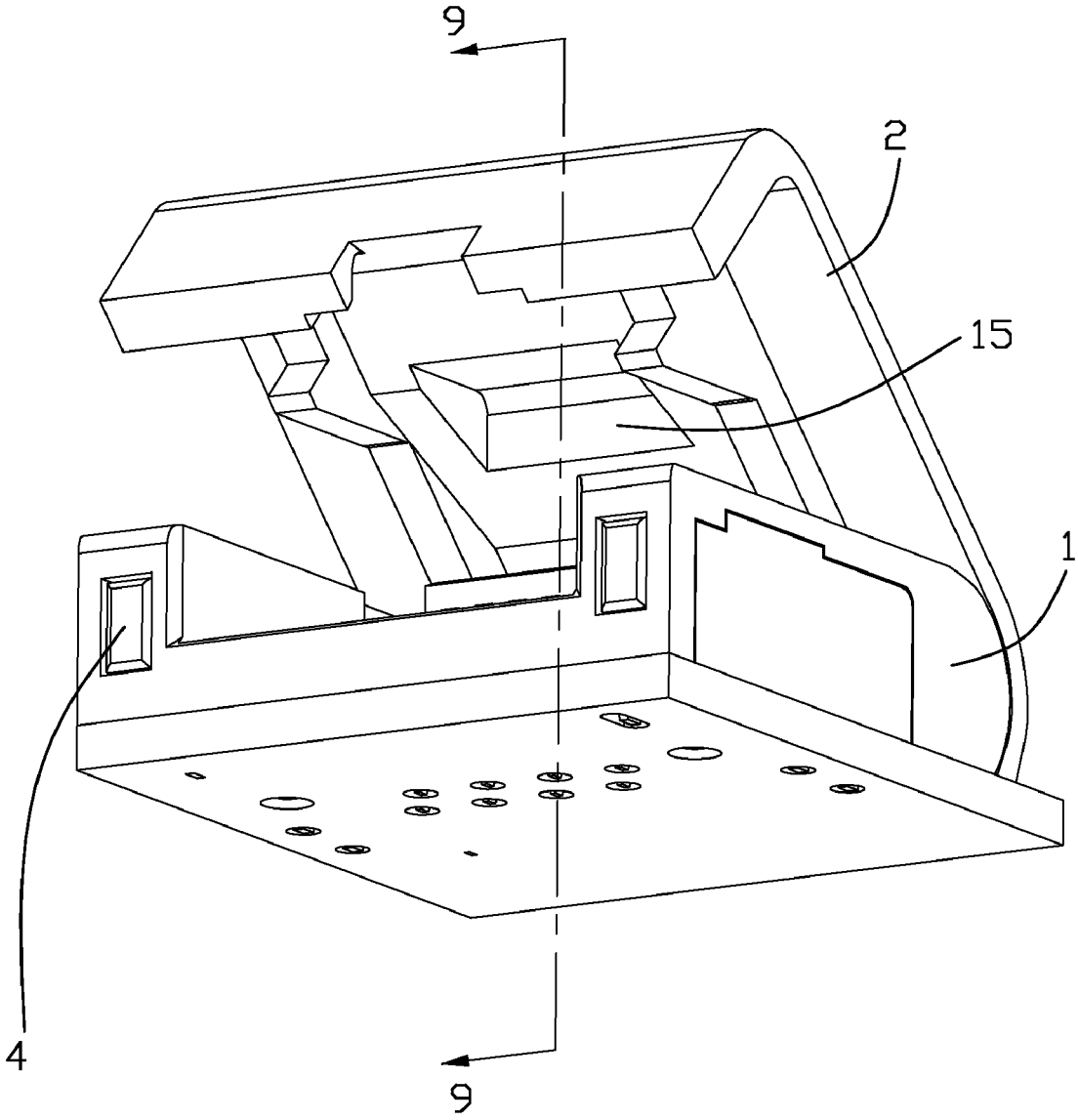
FIG. 2 is another perspective view of the electrical connector shown in FIG. 1.
Figure 3:
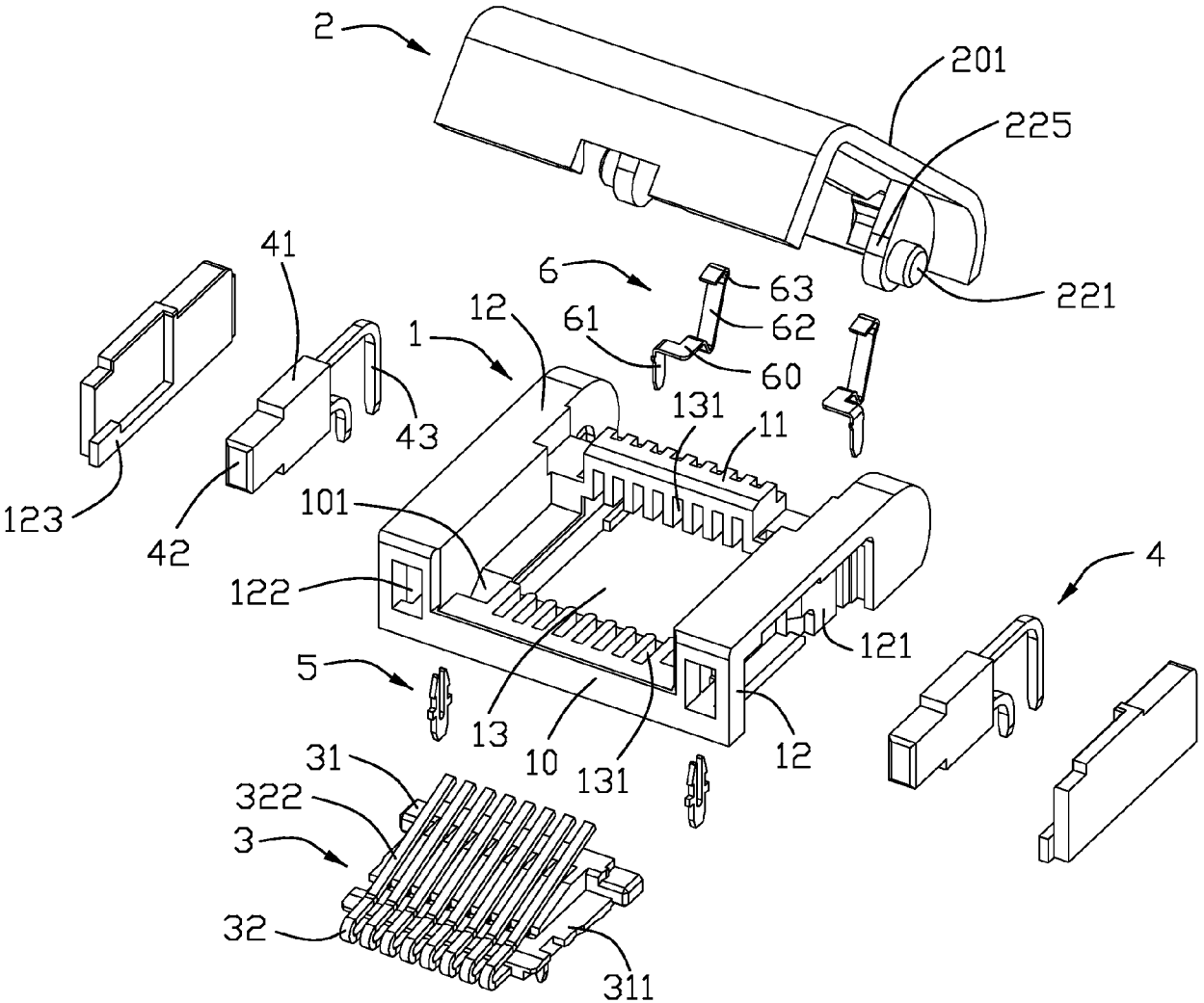
FIG. 3 is an exploded perspective view of the electrical connector shown in FIG. 1.

Reference will now be made to the drawing figures to describe a preferred embodiment of the present invention in detail. Referring to FIGS. 1 and 2, an electrical connector 100 made according to the preferred embodiment of the present invention is disclosed and mounted onto a printed circuit board (PCB) 200 for mating with a modular plug 300 such as a RJ45 plug. Said modular plug has a head 302 and an elastic latch 301 slantwise and upwardly extending from said head 302. Referring to FIG. 3, the electrical connector 100 comprises a base 1, a cover 2 pivotally assembled onto the base 1, a terminal insert 3 received in the base 1 and a pair of LED members 4 retained on the base 1. Combining with FIGS. 2 and 9, the cover 2 rotatably pivots about a pinshaft 221 formed on the cover 2 and rotates from a closed position where the base 1 is completely covered by the cover 2 to an opened position where the cover 2 is moved away from the base 1 so as to define a receiving cavity 15 for receiving the modular plug 300. Detailed description will be described hereafter.

Figure 4:
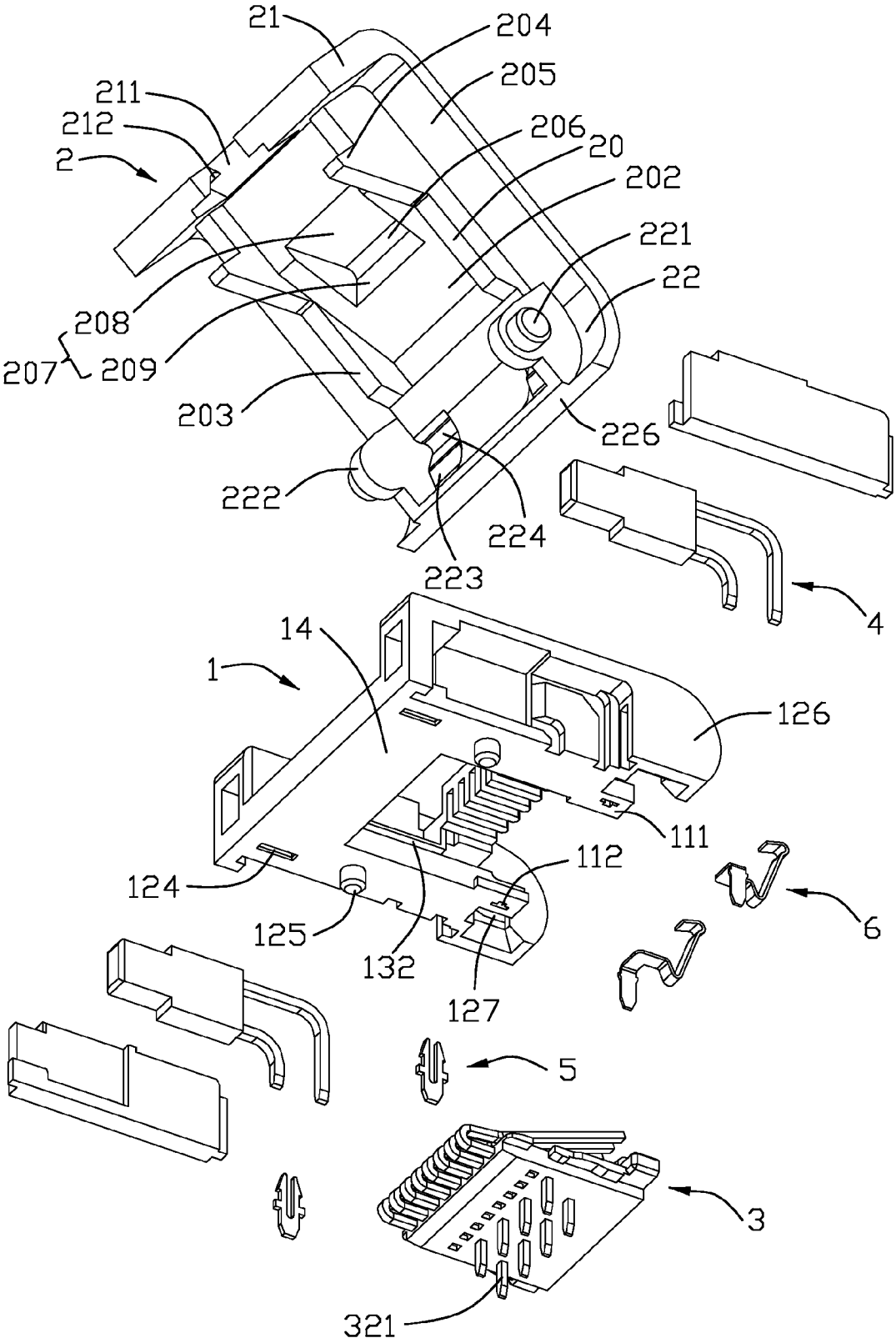
FIG. 4 is another exploded perspective view of the electrical connector shown in FIG. 1.

Referring to FIGS. 3 and 4, the base 1 is made in a rectangular configuration and comprises a front wall 10, a rear wall 11 and a pair of side walls 12 interconnected with each other thereby forming a holding space 13 in a middle portion. A bottom wall 14 which is also designated as a mounting face is formed under said front, rear and side walls 10, 11, 12 and faces to the PCB 200.

The terminal insert 3 is formed in an insert-molded manner and comprises an insulative base 31 and a plurality of terminals 32 secured in the insulative base 31. Each terminal 32 has a solder tail 321 perpendicularly extending out of the insulative base 31 and a contacting section 322 upwardly and slantwise extending from the insulative base 31. In addition, a pair of wings 311 are respectively formed at opposite sides of the insulative base 31 for slidably received in a pair of corresponding passageways 132 defined at opposite sides of the holding space 13. The terminal insert 3 is inserted into the holding space 13 from a rear end thereof with the pair of wings 311 forward moving along the passageways 132, meanwhile the contacting sections 322 are respectively received in the terminal grooves 131 defined on the rear wall 11. The front wall 10 also defines a plurality of terminal grooves 131 corresponding with terminal grooves 131 defined on the rear wall 11 for positioning said terminals 32.

A pair of recessed portions 121 are defined at outer side of the side walls 12 and run through a front face of each side wall 12 thereby defining an opening 122 in a front end. A pair of LED devices 4 are respectively received in said recessed portions 121, and each is configured as a vertical type and comprises a body portion 41 received in said recessed portion 121, an illumination portion 42 fitted in said opening 122, and a pair of solder portions 43 downwardly extending out of said recessed portion 121. Additionally, a pair of casings 123 are inserted into said recessed portions 121 along a vertical direction from the bottom wall 14 for preventing the LED device 4 releasing from the side wall 12.

Referring to FIG. 4, a pair of front through holes 124 and rear through holes 112 are respectively defined on front and rear sections of the bottom wall 14. In addition, a pair of posts 125 are also formed on the bottom wall 14 for positioning the electrical connector 100 on the PCB 200. A pair of board locks 5 are respectively retained in said front through holes 124 and inserted into corresponding holes on the PCB 200 for providing an anchoring force. At the end of each side wall 12, an extending portion 111 and a holding section 126 are separately formed with each other and protrude out of the rear wall 11. Said rear through holes 112 penetrate the extending portion 111 for respectively receiving a resilient tang 6 therein.

Figure 5:
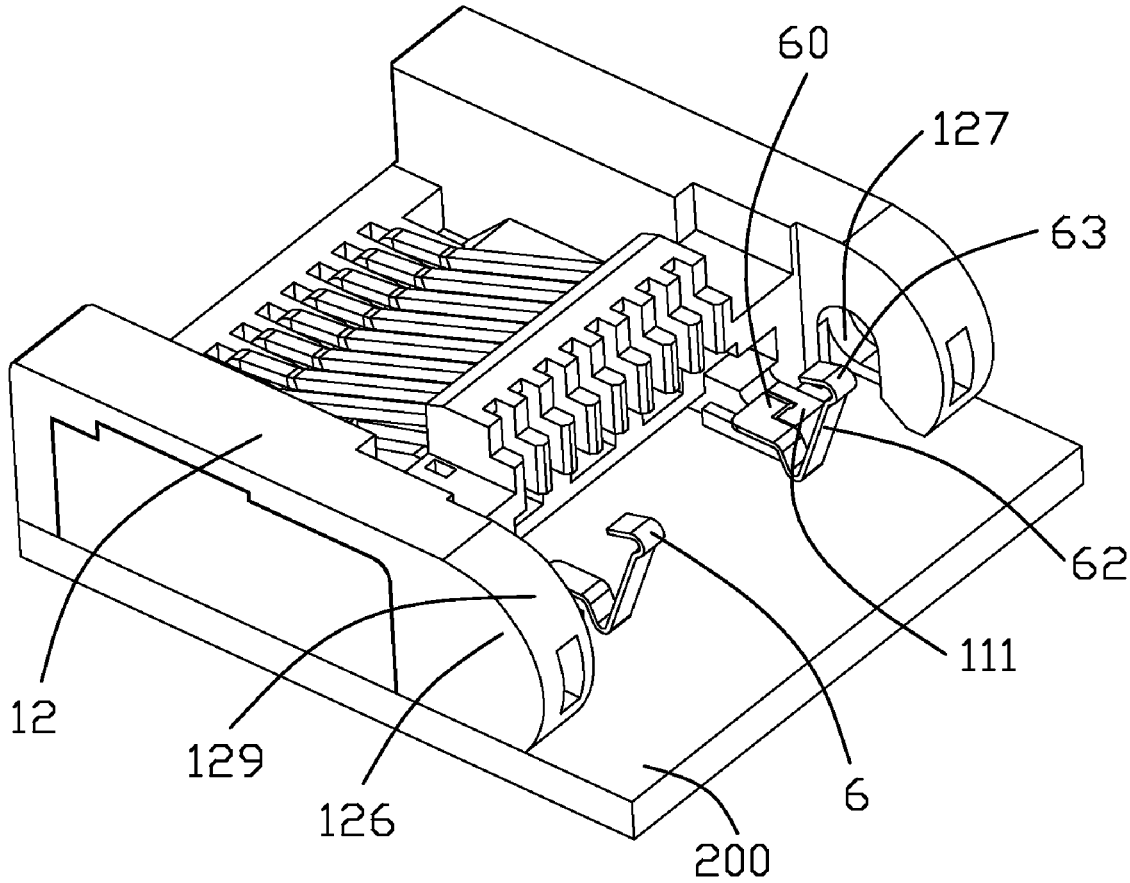
FIG. 5 is a perspective view of the electrical connector shown in FIG. 1 without a cover attached thereon.

Combining with FIGS. 3 and 5, the resilient tang 6 is made by stamping and bending from a metal piece, and comprises a horizontal body 60, a solder portion 61 perpendicularly extending from a side edge of the body 60, a connecting portion 62 extending downward from a rear edge of the body 60 and then upwardly extending to form a curved supporting portion 63 in a distal end thereof. The solder portion 61 is inserted into the rear through hole 112 with the body 60 abutting against the extending portion 111. The holding section 126 stands on the PCB 200 and defines a smooth guiding surface 129 in a continuous curved configuration. A circle aperture 127 is defined at an inner side of the holding section 126 to provide a space for receiving said pinshaft 221 of the cover 2.

Referring to FIGS. 3 and 4, the cover 2 has a rectangular base 20, a front skirt 21 and a rear skirt 22 respectively extending downward from a front edge and a rear edge of the base 20. The base 20 defines an upper face 201 and a lower face 202 located between said front and rear skirts 21, 22. The front skirt 21 comprises a pair of grasping portions 212 spaced from each other thereby defining a slot 211 located therebetween. The rear skirt 22 defines a curved inner face 228, on which a pair of flanges 222 are perpendicularly protruding downwards at opposite sides thereof. Each flange 222 forms a column pinshaft 221 protruding outwards from an outer surface of the flange 222 for pivotally receiving in said aperture 127 on the holding section 126. A first engaging face 223 and a second engaging face 224 are concaved inwardly on said curved inner face 228 adjacent to said flange 222 and an outwardly protruding boundary are defined therebetween to separate the two engaging faces. Furthermore, an abutment portion 226 is formed at a distal end of the rear skirt 22, and said first engaging face 223 is closer to the abutment portion 226 than the second engaging face 224.

Figure 9:
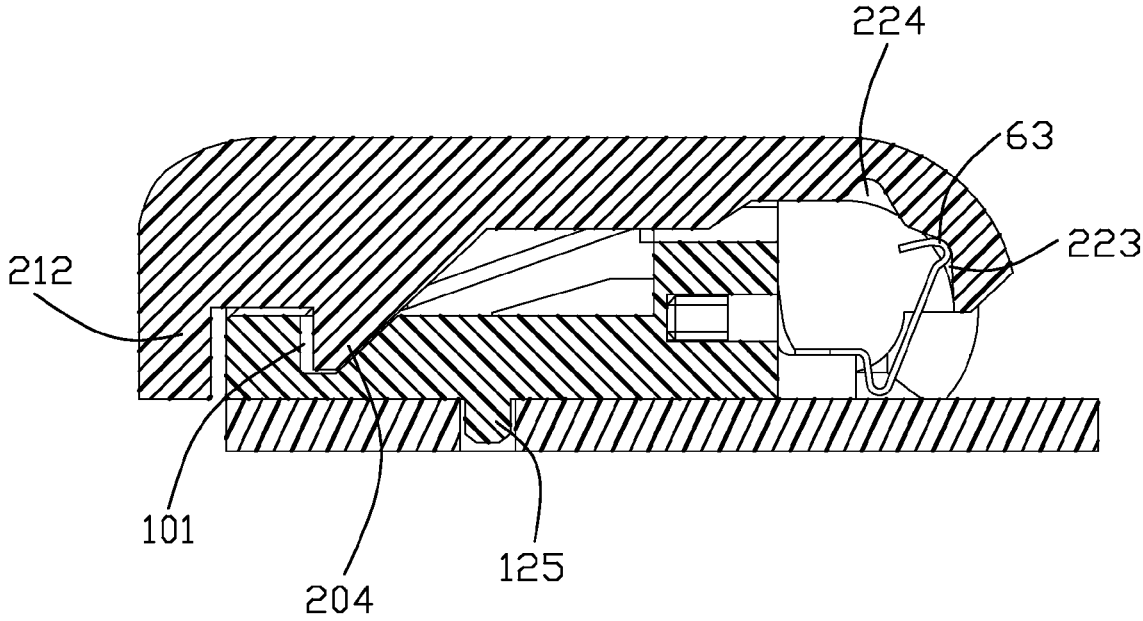
FIG. 9 is a cross sectional view of the electrical connector taken along line 9-9 shown in FIG. 2, which shows the cover in a closed position.

A pair of ribs 203 parallel to each other perpendicularly extend downwards from the lower face 202, on each of which a triangle configuration locking portion 204 protrudes outwards, therefore, when the cover 2 is in the closed position, the front skirt 21 locates in front of the base 1 with said ribs 203 received between the side walls 12, at the same time, said locking portions 204 insert into recesses 101 defined on the front wall 10 and snugly engage with the periphery of the recess 101 for preventing the cover 2 releasing from the base 1. Meanwhile, the supporting portion 63 abuts against the first engaging face 223 to keep the cover 2 in the closed position, which is best shown in FIG. 9. A concave portion 206 which is suit for receiving the head 302 of the modular plug 300 is formed on the lower face 202 and located between the pair of ribs 203. The concave portion 206 defines a stopping portion 207 therein, which comprises a first stopping face 208 and a second stopping face 209 which is perpendicular to the first stopping face 208.

Figure 6:
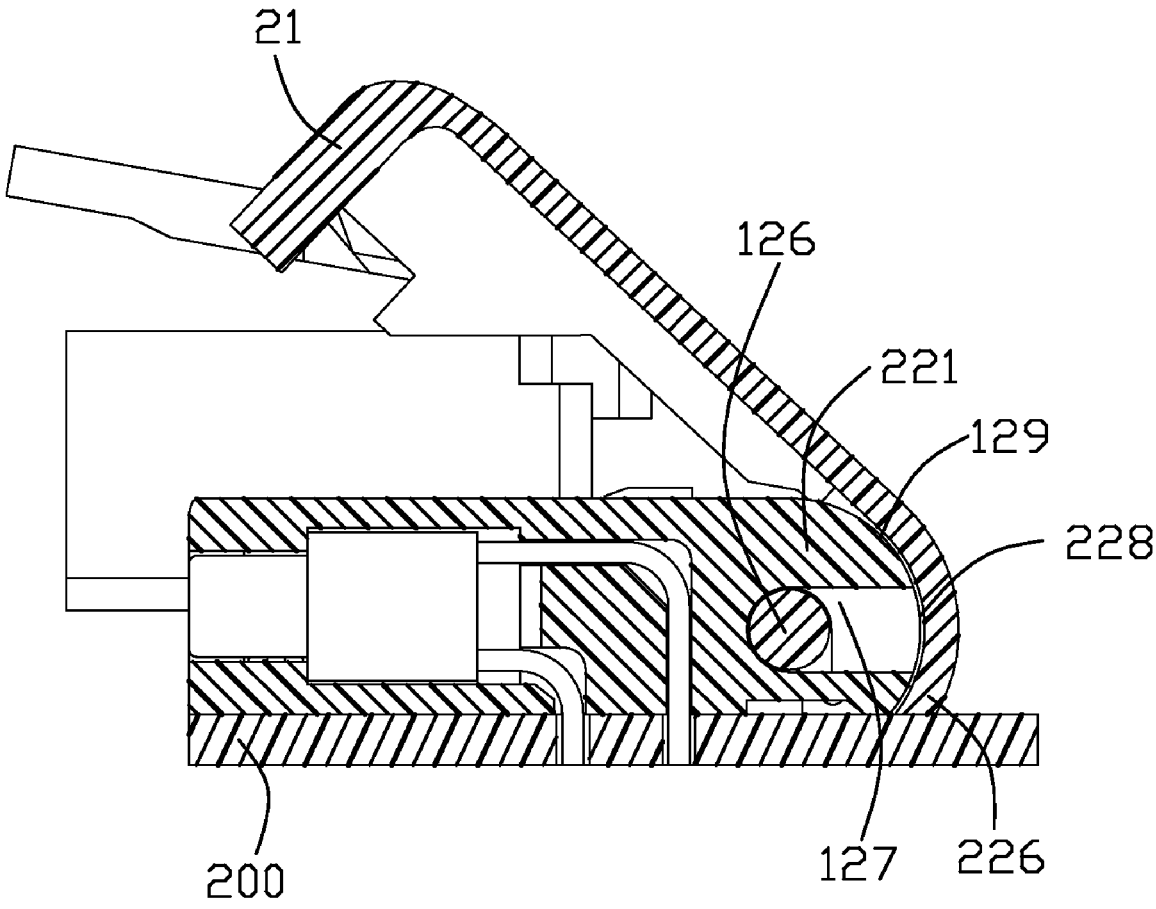
FIG. 6 is a cross sectional view of the electrical connector taken along line 6-6 shown in FIG. 1 with the modular plug mated thereto.
Figure 8:
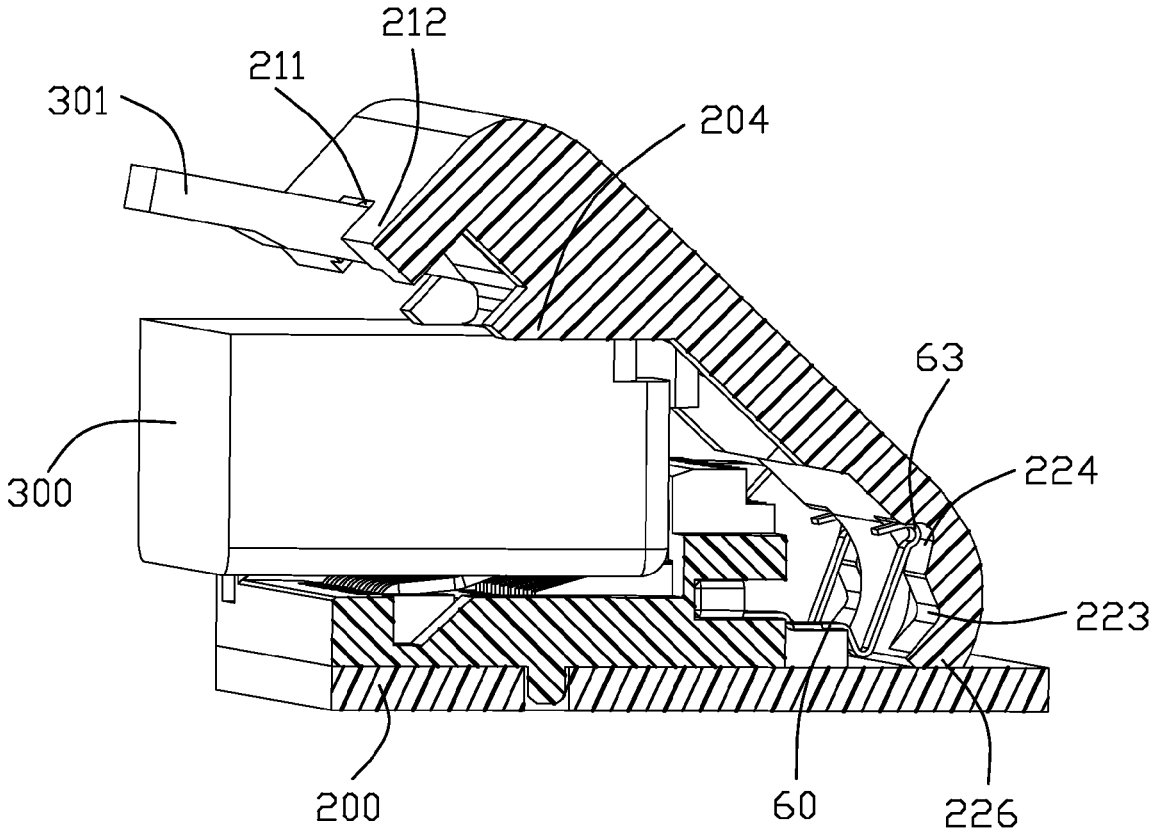
FIG. 8 is a partially cut-open view of the electrical connector taken along line 8-8.

Referring to FIG. 6, FIG. 8 and FIG. 9, the cover 2 is assembled on the base 1 with the pinshaft 221 pivotally received in the aperture 127. The cover 2 rotates about the pinshaft 221 along an inner face of the aperture 127, and the inner face 228 smoothly slides along the guiding surface 129 of the holding section 126. When the cover 2 rotates from the closed position to the opened position, the front skirt 212 moves upwardly and the abutment portion 226 moves downwardly so that the supporting portion 63 no longer engages with the first engaging face 223 but engages with the second engaging face 224, so the cover 2 is positioned in the opened position right now. After the electrical connector 1 is assembled onto the PCB 200, the abutment portion 226 abuts against the PCB 200 so that the cover 2 has no way to move upwardly further. At this point, the first stopping face 208 is parallel to the mounting face 14 and PCB 200 while the second stopping face 209 is perpendicular to the PCB 200. In the opened position, the receiving cavity 15 defined between the cover 2 and the base 1 is large enough for receiving the modular plug 300 therein; while in the closed position, the entrance of the mating cavity 15 is blocked such that the modular plug 300 can not be inserted therein.

Figure 7:
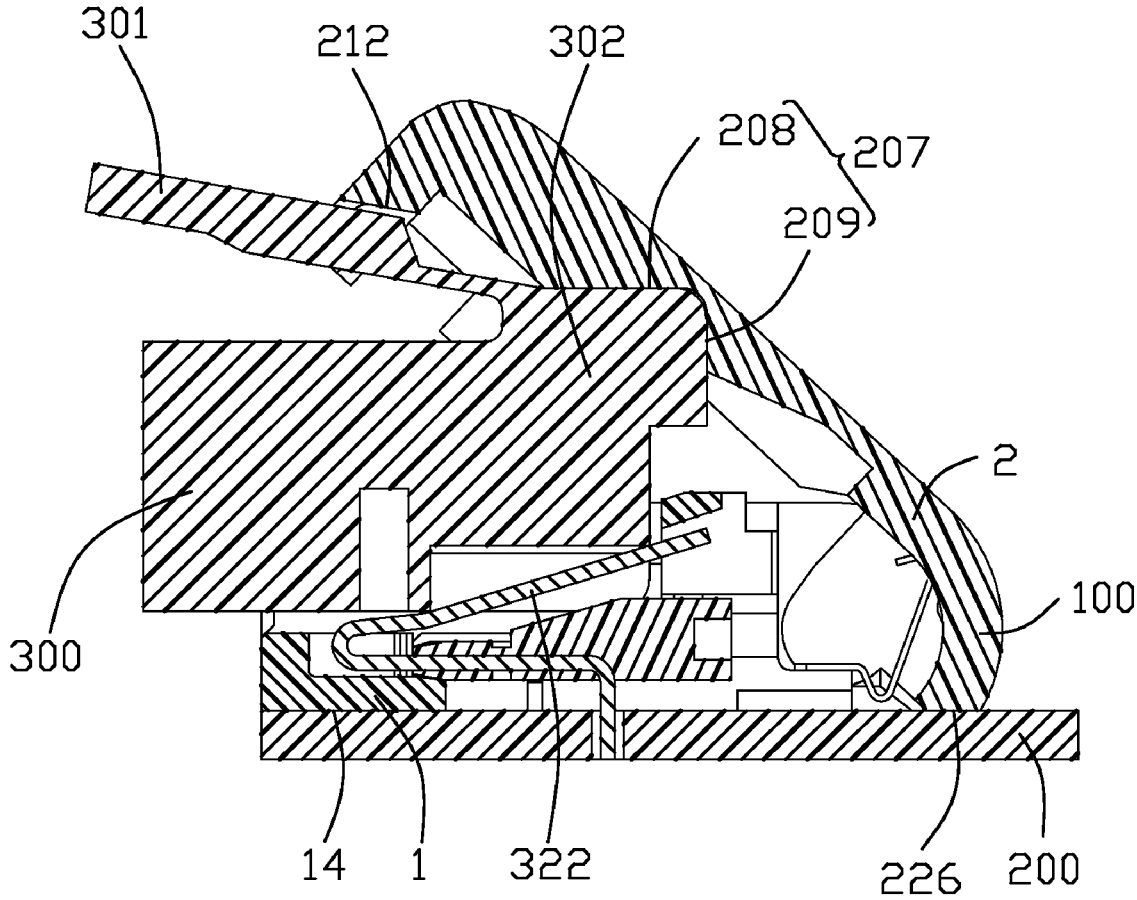
FIG. 7 is a cross sectional view of the electrical connector taken along line 7-7 shown in FIG. 1 with the modular plug mated thereto.

Best shown in FIGS. 7 and 8, when the electrical plug 300 is inserted into the cavity 15, the contacting sections 322 of the terminals 3 support the modular plug 300 in a cay that they will not to not contact with the front wall 10, the head 302 of the electrical plug 300 is fitted in the concave portion 206 and engages with the first and second stopping faces 208, 209, and the latch 301 is received in the slot 211 and buckled with the grasping portions 212. As the second stopping face 209 locates in front of the rear wall 11, the electrical plug 300 will not engage with the rear wall 11. In the present invention, the electrical plug 300 is kept away from the front wall 10 but directly contacts with the terminals 3 and blocks against the concave portion 206 so as to establish a steadily and reliable electrically connection therebetween. Moreover, the electrical plug 300 still is kept in a horizontal status during the assembling process, therefore the customer can easily get used to operational procedures. Furthermore, the rotation of the cover 2 can substantially reduce the height of the electrical connector, which can meet the miniaturization trend of the electrical connector 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative base defining a mounting face thereof for mounting to a printed circuit board;

terminals secured in said insulative base and each having a contacting section projecting upwards thereof;

a detachable cover pivotally assembled on the insulative base and rotated to an opened position where a mating cavity is defined for receiving a mating plug therein and a closed position where the mating cavity is not large enough for receiving said mating plug; and at least one resilient tang located under said cover for providing a supporting force no matter the cover is in the opened position or in the closed position;

wherein the contacting sections of the terminals project upward for supporting the mating plug not to contact with the insulative base;

wherein the cover forms a concave configuration comprising a first stopping face parallel to the printed circuit board and a second stopping face perpendicular to the printed circuit board for respectively engaging with the mating plug;

wherein the cover respectively forms a front skirt and a rear skirt, the front skirt covers a front end of the base when the cover is in a closed position, while the rear skirt covers a rear end of the base when the cover is in an opened position;

wherein the rear skirt defines a first and a second engaging faces separately defined and the first engaging face is closer to a rear end of the rear skirt, the resilient tang abut against the first engaging faces when the cover is in the opened position while the resilient tang abut against the second engaging faces when the cover is in the closed position.

2. The electrical connector as described in claim 1, wherein a pair of ribs respectively protrude downwards from the cover and extend along a mating direction, said ribs are received in the mating cavity when the cover is in the closed position and said stopping face is formed between said ribs.

3. The electrical connector as described in claim 1, wherein each tang has a horizontal base, a solder perpendicular extending downward from a side edge of the horizontal base and a supporting portion upward extending from a rear end of the horizontal base.

4. The electrical connector as described in claim 1, wherein a pair of locking portions further protrude downward from said ribs for receiving in corresponding apertures defined on the base when the cover is in the closed position.

5. The electrical connector as described in claim 1, wherein the base has a pair of sides thereof, and a pair of recesses are defined on an outer side of each side for respectively receiving a pair of LED devices therein.

* * * * *